US008500042B2

(12) United States Patent
Brown et al.

(10) Patent No.: US 8,500,042 B2
(45) Date of Patent: Aug. 6, 2013

(54) CONFIGURABLE ROTARY SPRAY NOZZLE

(75) Inventors: Gary Brown, Faribault, MN (US); Jaime Harris, Rosemount, MN (US); Dave Kennsinger, Richfield, MN (US); Chris Molitor, Savage, MN (US)

(73) Assignee: Hydra-Flex Inc., Burnsville, MN (US)

( * ) Notice: Subject to any disclaimer, the term of this patent is extended or adjusted under 35 U.S.C. 154(b) by 501 days.

(21) Appl. No.: 12/359,895

(22) Filed: Jan. 26, 2009

(65) Prior Publication Data

US 2009/0188993 A1 Jul. 30, 2009

Related U.S. Application Data

(60) Provisional application No. 61/023,314, filed on Jan. 24, 2008.

(51) Int. Cl.
*B05B 3/04* (2006.01)

(52) U.S. Cl.
USPC ..... 239/237; 239/240; 239/263; 239/381; 239/600

(58) Field of Classification Search
USPC ..... 239/380–383, 389, 237, 240, 263, 239/600
See application file for complete search history.

(56) References Cited

U.S. PATENT DOCUMENTS

| | | | | |
|---|---|---|---|---|
| 4,802,628 | A | | 2/1989 | Dautel et al. |
| 4,811,906 | A | | 3/1989 | Prus |
| 4,913,346 | A | | 4/1990 | Nakamura et al. |
| 5,039,013 | A | | 8/1991 | Sawade et al. |
| 5,060,862 | A | | 10/1991 | Pacht |
| 5,141,158 | A | | 8/1992 | Allen |
| 5,217,166 | A | | 6/1993 | Schulze et al. |
| 5,236,126 | A | | 8/1993 | Sawade et al. |
| 5,328,097 | A | * | 7/1994 | Wesch et al. ..... 239/243 |
| 5,332,155 | A | | 7/1994 | Jäger |
| 5,395,053 | A | * | 3/1995 | Frech ..... 239/227 |
| 5,456,413 | A | | 10/1995 | Ellis |
| 5,551,635 | A | | 9/1996 | Jäger |
| 5,597,119 | A | | 1/1997 | Gorney et al. |
| 5,598,975 | A | * | 2/1997 | Jager ..... 239/237 |
| 5,871,023 | A | | 2/1999 | Sherman, Jr. et al. |
| 5,908,349 | A | | 6/1999 | Warehime |
| 5,922,131 | A | | 7/1999 | Haas |
| 5,941,458 | A | * | 8/1999 | Hartmann ..... 239/381 |
| 6,027,040 | A | | 2/2000 | Frye-Hammelmann |

(Continued)

FOREIGN PATENT DOCUMENTS

JP 03679854 B2 5/2005

*Primary Examiner* — Steven J Ganey
(74) *Attorney, Agent, or Firm* — Patterson Thuente Pedersen, P.A.

(57) ABSTRACT

A configurable rotary spray nozzle having lower manufacturing and maintenance costs through the use of an external shell providing strength and resistance to damage such that molded internal components can be utilized to provide the desired spray characteristics. The molded internal wet components can comprise molded polymeric structures that allow for the formation of complex flow geometries and structures that are either impossible or economically impractical to achieve with conventional tooling and machining operations. The use of an external shell provides for use of replacement kits to maintain or otherwise replace worn and/or damaged internal wet components while reusing the external housing. The use of the external shell also allows a user to customize and change spray performance of the configurable rotary spray nozzle by swapping internal wet components having selected flow geometries and characteristics so as to provide a desired spray performance.

5 Claims, 7 Drawing Sheets

U.S. PATENT DOCUMENTS

| | | | | |
|---|---|---|---|---|
| 6,029,906 | A * | 2/2000 | Binder et al. | 239/237 |
| 6,129,293 | A * | 10/2000 | Jager | 239/227 |
| 6,196,475 | B1 | 3/2001 | Jaeger | |
| 6,250,566 | B1 * | 6/2001 | Jager | 239/237 |
| 6,592,057 | B1 | 7/2003 | Ericksen et al. | |
| 7,118,051 | B1 * | 10/2006 | Jager | 239/381 |
| 7,552,878 | B2 * | 6/2009 | Jager | 239/381 |
| 7,635,095 | B2 * | 12/2009 | Jaeger | 239/237 |
| 2001/0019083 | A1 | 9/2001 | Marks | |
| 2002/0107132 | A1 | 8/2002 | Fischer et al. | |

* cited by examiner

CONFIGURABLE ROTARY SPRAY NOZZLE

PRIORITY CLAIM

The present application claims priority to U.S. Provisional Application Ser. No. 61/023,314, filed Jan. 24, 2008, and entitled "CONFIGURABLE ROTARY SPRAY NOZZLE", which is herein incorporated by reference in its entirety.

FIELD OF THE DISCLOSURE

The present disclosure is directed to a rotary spray nozzle for use in both high and low pressure spray applications. More specifically, the present invention is directed to a rotary spray nozzle having internal nozzle components molded from suitable polymers and a metal housing enclosing the internal nozzle components.

BACKGROUND OF THE DISCLOSURE

Rotary spray nozzles are well known and are frequently used in spray applications such as, for example, automated car wash applications. Conventional rotary spray nozzles are essentially metallic structures having an internal rotor with one or more elastomeric o-rings for increasing friction and controlling rotation speed. Representative metallic materials for constructing said rotary spray nozzles can include stainless steel, aluminum, brass and any variety of suitable metals or alloys depending upon environmental and liquid compatibility concerns. Representative spray nozzles of the prior art include U.S. Pat. Nos. 4,802,628, 4,811,906, 4,913,346, 5,039,013, 5,060,862, 5,141,158, 5,217,166, 5,236,126, 5,328,097, 5,332,155, 5,395,053, 5,456,413, 5,551,635, 5,597,119, 5,598,975, 5,871,023, 5,908,349, 5,922,131, 5,941,458, 6,027,040, 6,196,475, 6,250,566 and U.S. Patent Publication No. 20020107132, all of which are herein incorporated by reference in their entirety.

As use of the rotary spray nozzles is often conducted in harsh and unforgiving environments, the individual components can experience failure such that the rotary spray nozzle must be completely replaced. As such, it would be beneficial to have designs resulting in lower cost and providing ease of replacement and/or repair.

SUMMARY OF THE DISCLOSURE

A configurable rotary spray nozzle of the present disclosure provides for lower manufacturing and maintenance costs through the use of an external shell providing strength and resistance to damage, such as for example, physical, corrosive or environmental damage, such that lower cost molded internal components can be utilized to provide the desired spray characteristics. Generally, the external shell comprises a multi-piece metallic structure that encases the molded internal wet components. The external shell can comprise any variety of metals or metal alloys that are suitably compatible with environmental, operational and/or fluid properties. Representative metallic materials for forming the external shell can comprise aluminum, stainless steel, brass and the like. The molded internal wet components can comprise molded polymeric structures that allow for the formation of complex flow geometries and structures that are either impossible or economically impractical to achieve with conventional tooling and machining operations. The internal wet components can comprise representative moldable polymers that are selected based on fluid, pressure and temperature compatibility. In some embodiments, the use of an external shell can provide for use of replacement kits to maintain or otherwise replace worn and/or damaged internal wet components while reusing the external housing. In some embodiments, the use of an external shell allows a user to customize spray performance of a configurable rotary spray nozzle by swapping internal wet components having desired molded configurations selected flow geometries so as alter or otherwise provide a desired spray performance.

In some embodiments, the present disclosure is directed to a configurable rotary spray nozzle having an external shell enclosing molded internal wet components. The external shell provides strength and resistance to damage such that molded internal wet components having complex molded flow geometries can be utilized to provide desired spray performance.

In some embodiments, the present disclosure is directed to a replacement kit for changing worn internal wet components in a configurable rotary spray nozzle. The replacement kit can include one or more of an inlet member, an internal shell member, a sleeve and/or a rotor such that original spray performance can be returned to the configurable rotary spray nozzle.

In some embodiments, the present disclosure is directed to a replacement kit for varying spray performance of a configurable rotary spray nozzle. The replacement kit can include one or more of an inlet member, an internal shell member, a sleeve and/or a rotor such that spray performance can be varied from that originally experienced with the configurable rotary spray nozzle.

In some embodiments, the present disclosure is directed to a method of manufacturing a configurable rotary spray nozzle comprising providing an external shell to provide strength and damage resistance to an internal molded shell member. The method can further comprise separating the external shell to provide access to the internal molded shell member such that worn molded internal wet components can be replaced and the external shell reused. The method can further comprise integrally molding complex flow geometries during formation of the molded internal wet components.

In some embodiments, the present disclosure is directed to a method for configuring spray performance of a configurable rotary spray nozzle by providing a rotary spray nozzle having an outer shell enclosing molded internal wet components. The method further comprises providing a replacement kit including one or more of the molded internal wet components. Finally, the method comprises separating the outer shell to replace one or more of the internal wet components. In some embodiments, the method can further comprise restoring an original spray performance of the configurable rotary spray nozzle. In some embodiments, the method can further comprise alternating the original spray performance of the configurable rotary spray nozzle.

The above summary of the various aspects of the disclosure is not intended to describe each illustrated embodiment or every implementation of the invention. The figures in the detailed description that follow more particularly exemplify these embodiments.

DESCRIPTION OF THE FIGURES

These, as well as other objects and advantages of this invention, will be more completely understood and appreciated by referring to the following more detailed description of the presently preferred exemplary embodiments of the invention in conjunction with the accompanying drawings, of which.

Figure 1:
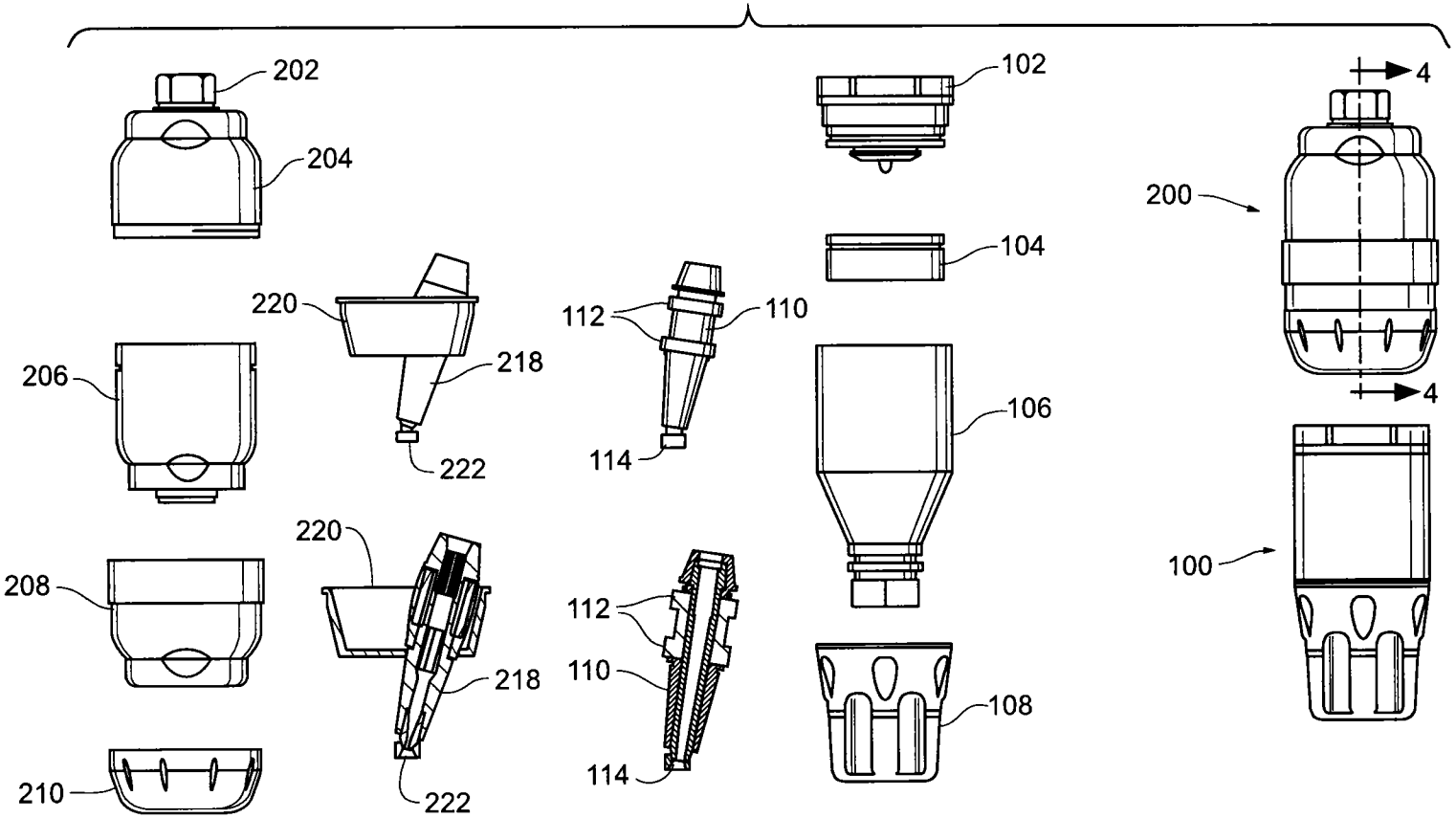
FIG. 1 is a side view illustration of a conventional rotary spray nozzle with an embodiment of a configurable rotary spray nozzle according to the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DISCLOSURE

Referring now to FIG. 1, a conventional rotary spray nozzle 100 of the prior art generally comprises an inlet member 102, an endcap 104, a housing member 106 and a cover 108. Typically, at least inlet member 102, endcap 104 and housing member 106 are machined from metal or metal alloy blocks such as, for example, aluminum, brass, stainless steel and the like. A rotor 110, one or more o-rings 112 and a seat 114 generally reside within conventional rotary spray nozzle 100. In operation, a fluid to be sprayed enters the inlet member 102 where it is routed by fluid passages within the endcap 104. The fluid passages with the endcap 104 direct the water in a tangential direction to the incoming flow such that the fluid is directed against the housing member 106. The fluid causes rotor 110 to spin inside the housing member 106. As the rotor 110 is spinning, the fluid enters a rotor inlet 116, flows through a rotor lumen 118 and exits a rotor outlet 120. At the rotor outlet 120, rotor 110 is spinning about the seat 114 such that the fluid is sprayed from the conventional rotary spray nozzle 100 in a substantially circular pattern. As rotor 110 spins, the one or more o-rings 112 provide friction to slow the spinning velocity of the rotor 110 such that the fluid exiting the rotor outlet 120 maintains a substantially continuous stream.

Referring again to FIG. 1 as well as FIGS. 2-5, a configurable rotary spray nozzle 200 of the present disclosure provides additional functionality to rotary spray designs. Generally, configurable rotary spray nozzle 200 comprises an inlet member 202, a first outer shell member 204, an internal shell member 206, a second outer shell member 208 and a cover 210. Inlet member 202 can be positioned in an inlet bore 205 such that a retaining ring 207 couples the inlet member 202 to the first outer shell member 204. First outer shell member 204 and second outer shell member 208 are formed of a metal or metal alloy such as, for example, aluminum, brass, stainless steel and the like.

Figure 3:
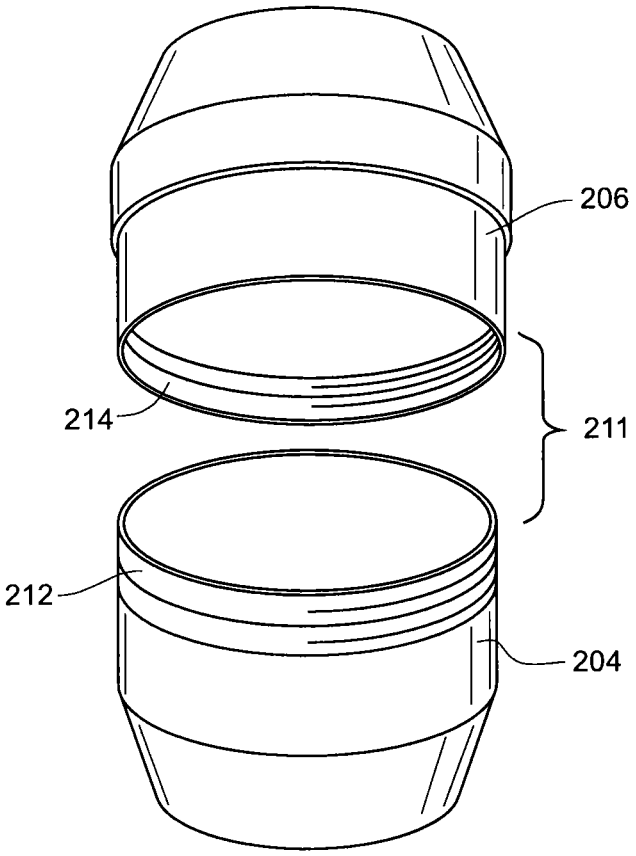
FIG. 3 is an exploded, perspective view of an external housing of the present disclosure.

In some embodiments, configurable rotary spray nozzle 200 can comprise a threaded engagement mechanism 211 as shown in FIG. 3 such as, for example, an external thread 212 on first outer shell member 204 configured to engage an internal thread 214 on second outer shell member 208 so as to form a joined outer shell 216. In addition to threaded engagement, first outer shell member 204 and second outer shell member 208 can be engaged using any suitable connection including, for example, quick connections including compression or twist style engagement mechanisms, z-thread or quarter turn engagement mechanisms, snap detent mechanisms and the like.

Figure 2:
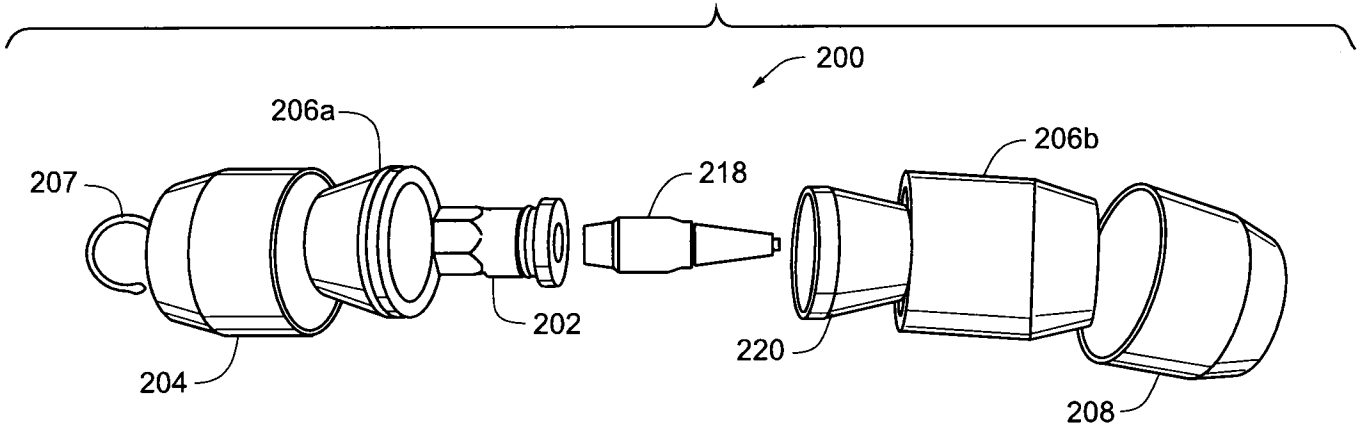
FIG. 2 is an exploded, plan view of the configurable rotary spray nozzle of FIG. 1.
Figure 4:
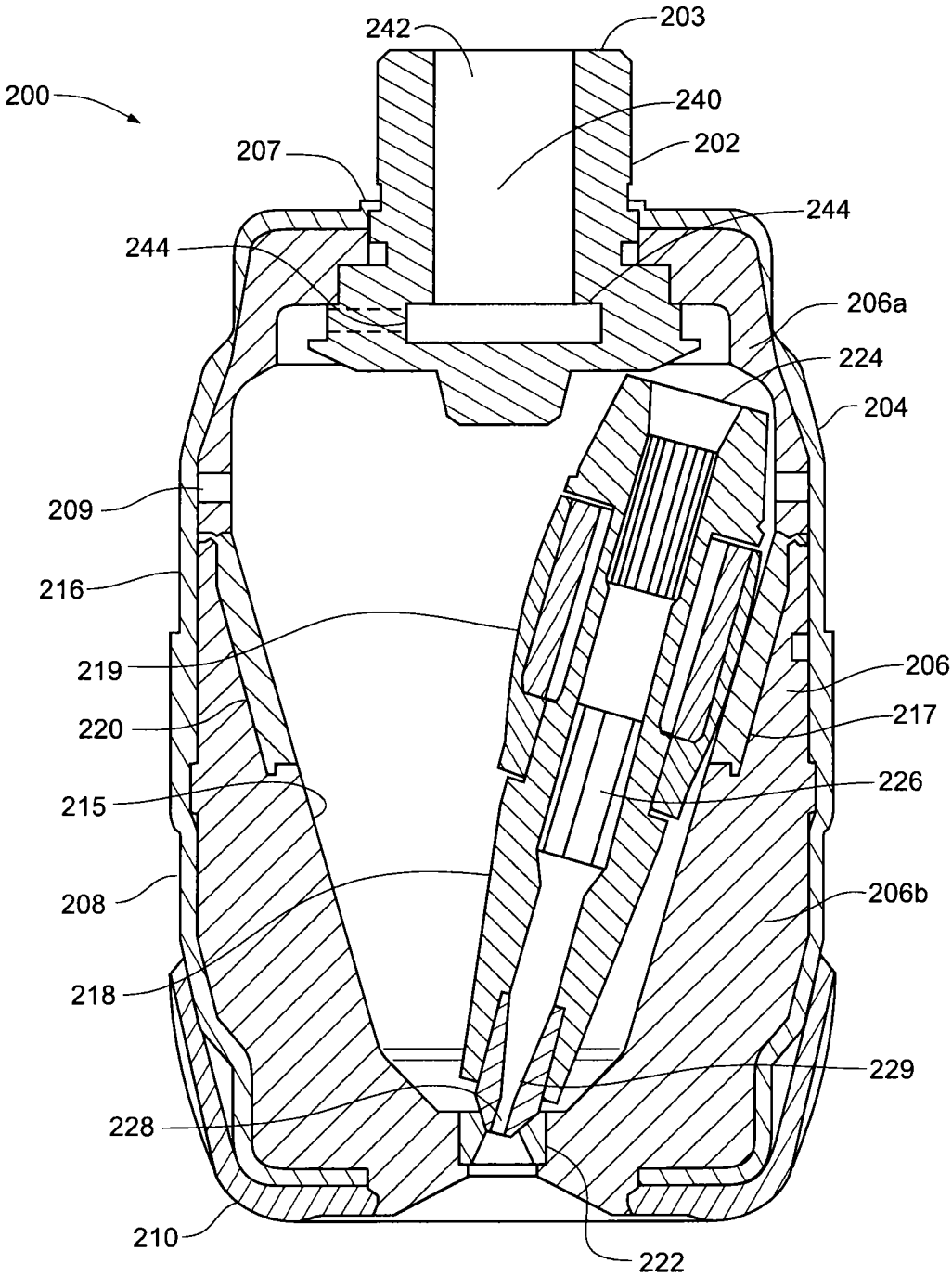
FIG. 4 is a section view of the configurable rotary spray nozzle of FIG. 1 taken at line 4-4 of FIG. 1.
Figure 5:
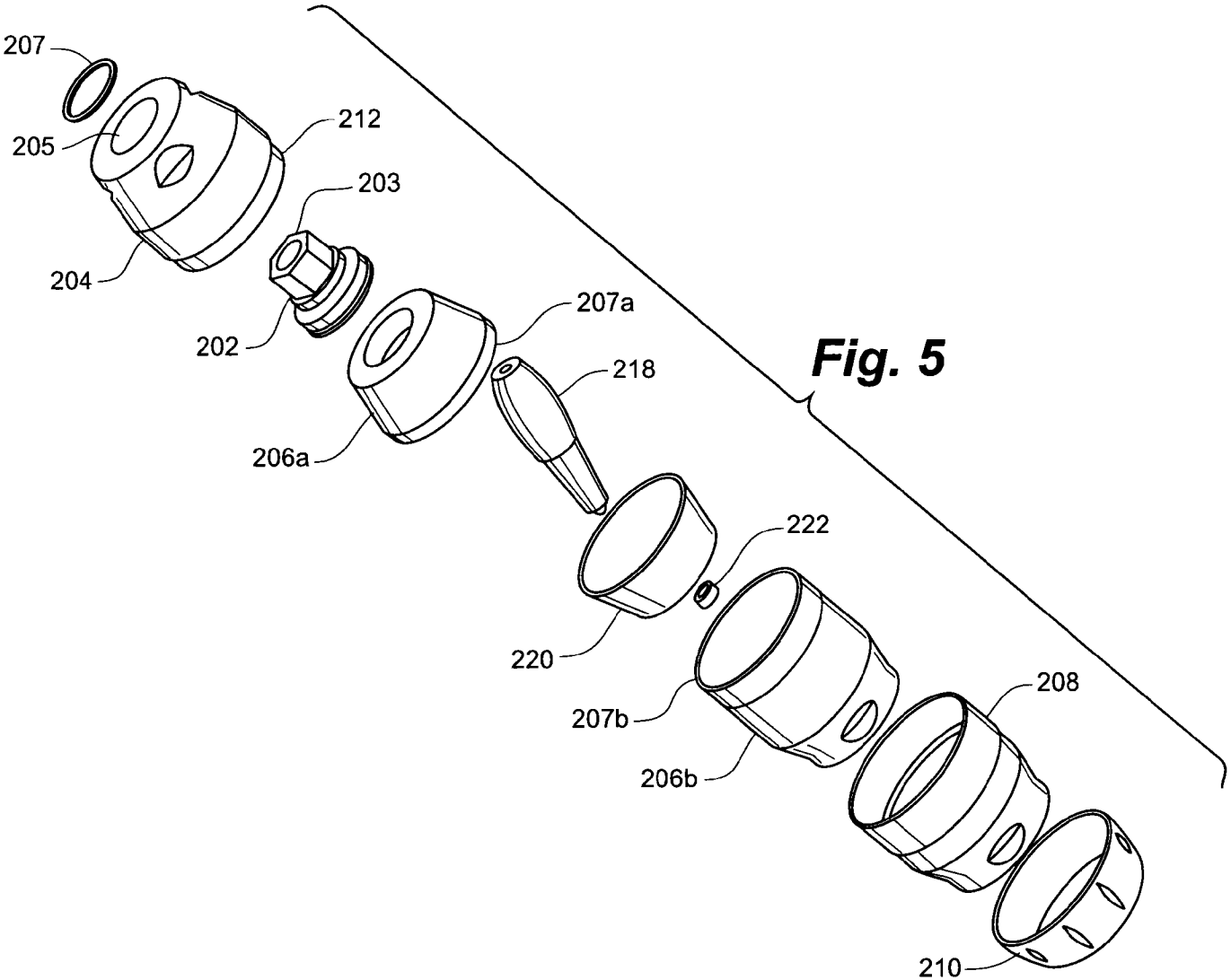
FIG. 5 is an exploded, perspective view of the configurable rotary spray nozzle of FIG. 1.

Referring to FIGS. 2, 4 and 5, internal shell member 206 generally comprises two or more housing portions illustrated as 206*a* and 206*b*. Internal shell members 206*a*, 206*b* each include a corresponding sealing surface 207*a* 207*b*. When approximated and retained within the joined outer shell 216, an internal shell seal 209 is captured and compressed between the sealing surfaces 207*a*, 207*b* so as to provide a fluid tight seal and prevent migration of the fluid into the joined outer shell 216. Internal shell seal 209 can comprise an o-ring style configuration formed of a polymer selected for compatibility with the fluid. When approximated and retained within the joined outer shell 216, internal shell member 206 defines an internal wall profile 215 having a mounting recess 217. Internal shell member 206 is generally molded of suitable polymeric materials. Joined outer shell 216 generally provides environmental protection to the internal components while axially and diametrically reinforcing the configurable rotary spray nozzle 200, and the internal shell member 206 specifically. With this reinforcement, moldable polymeric materials that would otherwise be prone to damage or other failures can be utilized as the molding operation allows for the formation of complex flow geometries integral to the internal wet components that would be otherwise impossible or economically unfeasible to accomplish.

Inlet member 202 can comprise a connection end 203 configured to engage an existing plumbing system. Connection end 203 can comprise a variety of connection types including threaded or clamped fittings. In one preferred embodiment, connection end 203 comprises a quick-connect fitting such as, for example, a compression or twist style engagement mechanisms, z-thread or quarter turn engagement mechanisms, snap detent mechanisms and the like. Inlet member 202 is generally formed of a metal or metal alloy such as, for example, aluminum, brass, stainless steel and the like so as to provide necessary strength and durability when connecting to the existing pluming system. Inlet member 202 generally comprises a fluid channel 240 defined by an inlet channel 242 and one or more tangential discharge channels 244.

Referring now to FIGS. 1-5, internal wet components of the configurable rotary spray nozzle 200 can further comprise a rotor 218, a sleeve 220 and a seat 222 residing with the internal shell member 206. Sleeve 220 comprises an elastomeric material and provides for an increased life span and surface area for engagement with the rotor 218 when compared to the one or more o-rings 112. Sleeve 220 can be specially configured using desired materials or sizes to control the level of frictional engagement with the rotor 218. Sleeve 220 is sized so as to be removably mountable within the mounting recess 217. Seat 222 is preferably press-fit into the internal shell member 206*b* such that the seat 222 remains properly positioned and retained during operation.

Figure 6:
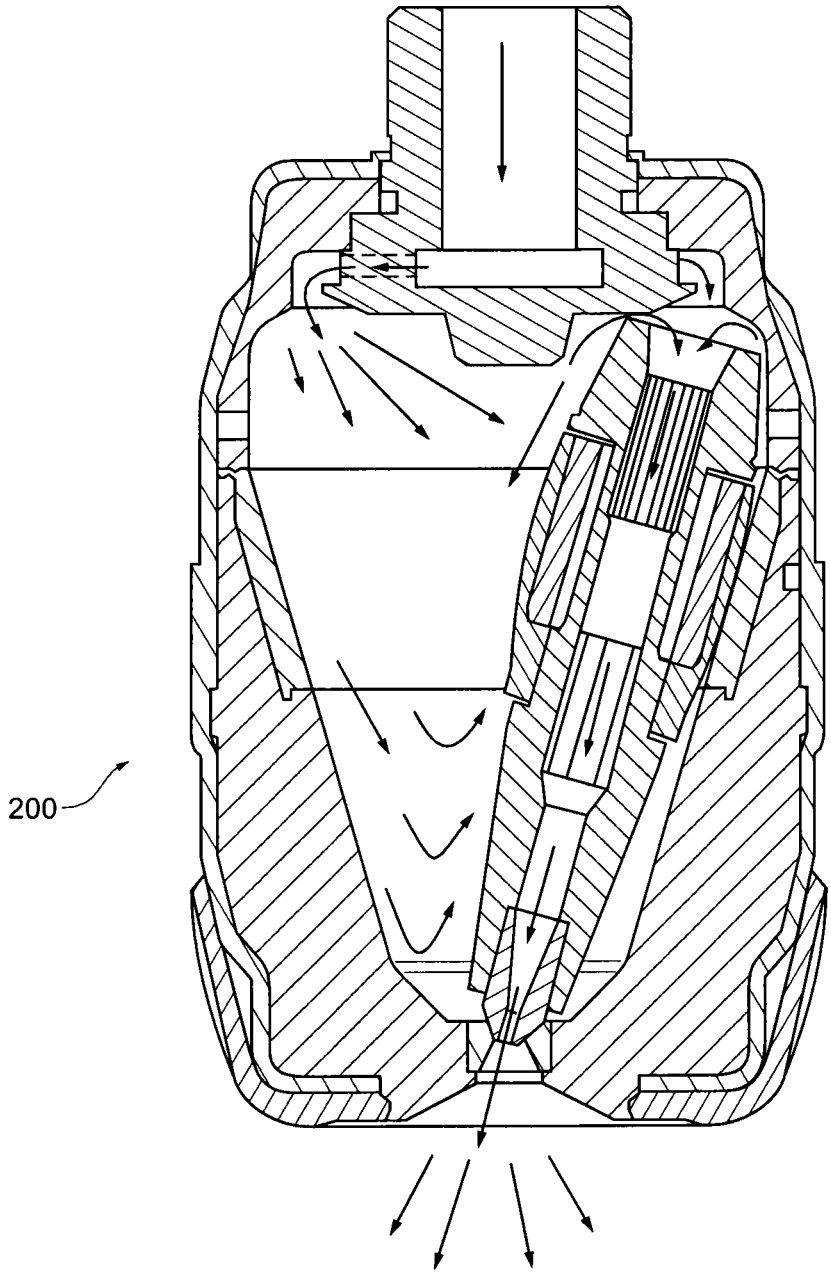
FIG. 6 is a section view of the configurable rotary spray nozzle of FIG. 1 take at line 4-4 of FIG. 1 illustrating a representative flow pattern within the configurable rotary spray nozzle.

As illustrated in FIG. 6, configurable rotary spray nozzle 200 functions in a similar fashion as conventional rotary spray nozzle 100 during spraying of a fluid by allowing a fluid to enter through the inlet channel 242 of inlet member 202 as illustrated by the flow arrows. The tangential discharge channels 244 within the inlet member 202 direct the water in a tangential direction to the incoming flow such that the fluid is directed against the internal wall profile 215 of internal shell member 206 causing the rotor 218 to spin inside the internal shell member 206 as illustrated generally in FIG. 6. As the rotor 218 is spinning, the fluid enters a rotor inlet 224, flows through a rotor lumen 226 and exits a rotor outlet 228. Rotor lumen 226 typically includes a flow restriction 229 resulting in acceleration of the fluid velocity to provide enhanced spray characteristics. At the rotor outlet 228, rotor 218 is spinning about the seat 222 such that the fluid is sprayed from the configurable rotary spray nozzle 200 in a substantially circular pattern. As rotor 218 spins, a contact portion 219 of rotor 218 engages sleeve 220 that provides friction to slow the spinning velocity of the rotor 218 such that the fluid exiting the rotor outlet 228 maintains a substantially continuous stream.

Due to the additional strength and reinforcement provided by the outer shell 216, the internal wet components such as the inlet member 202 and internal shell member 206 can be molded using suitable polymeric materials. Generally, appropriate polymers will exhibit suitable chemical and temperature compatibility with the fluid to be sprayed. By molding the internal wet components, specialized flow patterns can be introduced to vary the performance of the configurable rotary spray nozzle 200 that are either impossible or impractical to fabricate with conventional machining and milling technologies. Using molded internal wet components save costs in both raw materials and in the time savings resulting from molding as opposed to machining and milling of the components.

After periods of extended use, the internal wet components of the configurable rotary spray nozzle 200 can suffer wear leading to performance degradation and possible failure. Due to the separability of joined outer shell 216 into first outer shell member 204 and second outer shell member 208, the worn internal wet components can be accessed and replaced with new internal wet components without requiring full replacement of the configurable rotary spray nozzle 200. Depending upon the amount of wear on these components, individual items such as, for example, the rotor 218 or sleeve 220 can be supplied or alternatively, a repair kit comprising inlet member 202, internal shell members 206*a*, 206*b* (including press-fit seat 222), internal shell seal 209, rotor 218, and sleeve 220. In some embodiments, replacement kits can be utilized not merely to replace worn internal wet components but can further be provided to alter the spray performance of the configurable rotary spray nozzle 200. For instance, replacement kits can comprise a selected inlet member 202 as well as specially molded internal wet components such as the internal shell members 206*a*, 206*b*, rotor 218 and/or sleeve 220 to allow a user to selectively vary the spray performance of the configurable rotary spray nozzle 200 by adjusting geometries of components and/or flow channels. In this way, a user can essentially change or customize the spray pattern and performance of the configurable rotary spray nozzle 200. This can be especially advantageous in spraying operations where new fluids are continually introduced to improve spray and/or cleaning performance such as in automated car wash applications.

Figure 7:
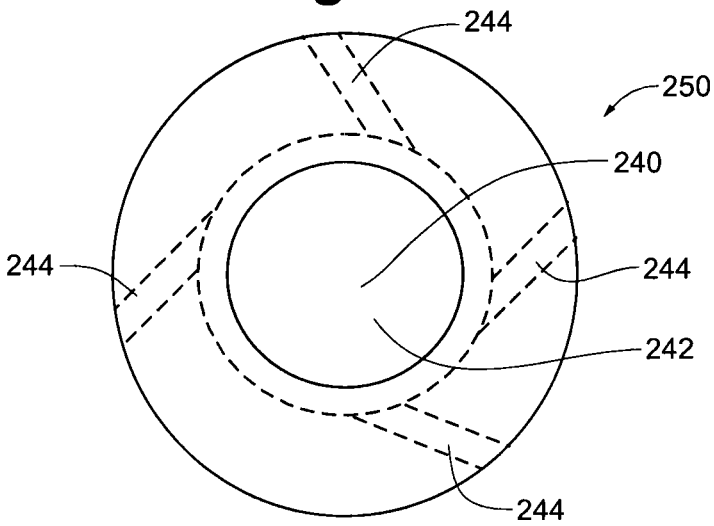
FIG. 7 is a plan, partially hidden view of an inlet member according to an embodiment of the present disclosure.
Figure 8:
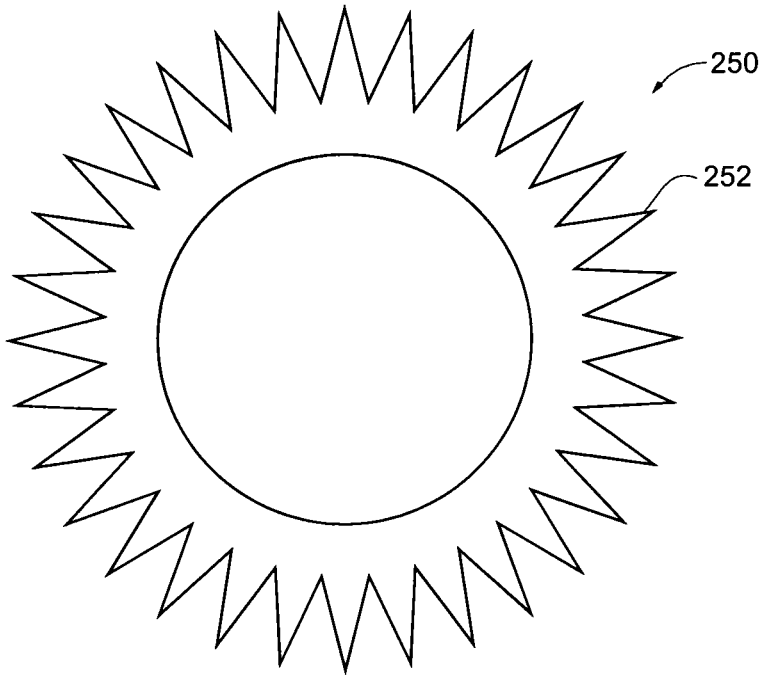
FIG. 8 is a section view of a sleeve according to an embodiment of the present disclosure.

With respect to altering or otherwise changing the spray performance of the configurable rotary spray nozzle 200, a variety of component design changes can be utilized as part of a replacement kit. Referring now to FIGS. 4 and 7, a replacement for inlet member 202 can include dimensional or configuration changes to fluid channel 240. In some instances, the inlet channel 242 can have an increased or decreased diameter or alternatively, the diameter or even number of tangential discharge channels 244 can be varied. Alternatively, internal shell members 206*a*, 206*b* can be designed to provide a different internal wall profile 215. Sleeve 220 can be replaced with a new sleeve formed of a different polymer with different friction characteristics. Alternatively, sleeve 220 can be replaced with a sleeve 250 in which an engagement surface 252 has been formed with ridges, grooves, channels and the like to enhance frictional engagement between the sleeve 250 and the contact portion 219 of rotor 218. Finally, rotor 218 can be replaced with an alternative rotor 218 that can be molded of a polymeric material having different frictional characteristics or having differing dimensions for the rotor inlet 224, rotor lumen 226, flow restriction 229 and/or rotor outlet 228. In addition, rotor 218 can be molded to provide contact portion 219 with ridges, grooves, channels and the like to selectively adjust the frictional engagement characteristics with sleeve 220. Depending upon the replacement to be performed, suitable replacement kits will generally include one or more of inlet member 202, internal shell members 206*a*, 206*b*, internal shell seal 209, sleeve 220, rotor 218 in almost any combination. Regardless of the replacement combination, first outer shell member 204 and second outer shell member 208 continue to form joined outer shell 216 to provide the necessary strength and rigidity necessary to use molded, internal wet components.

It will thus be seen according to the present disclosure, a highly advantageous configurable rotary spray nozzle has been provided. While the invention has been described in connection with what is presently considered to be the most practical and preferred embodiment, it will be apparent to those of ordinary skill in the art that the invention is not to be limited to the disclosed embodiment, that many modifications and equivalent arrangements may be made thereof within the scope of the invention, which scope is to be accorded the broadest interpretation of the appended claims so as to encompass all equivalent structures and products.

The invention claimed is:

1. A configurable rotary spray nozzle comprising:

a first outer shell member and a second outer shell member each formed from a metal or metal alloy, the first outer shell member and second outer shell member operably coupled to define an outer shell;

a fluid tight internal shell formed from a first molded internal shell member and a second molded internal shell member, the first and second molded internal shell members cooperatively defining an internal wall profile, the second molded internal shell including a rotor seat mounted proximate a spray outlet aperture, wherein the fluid tight internal shell is encased within the outer shell such that the fluid tight internal shell is axially and diametrically reinforced by the outer shell;

an inlet member having a fluid channel defined by an inlet channel and at least one tangential discharge channel;

an elastomeric sleeve positioned against the internal wall profile; and a molded rotor having rotor body defined by an inlet end, a contact portion and an outlet end, the contact portion adapted to frictionally engage the elastomeric sleeve as the outlet end resides within the rotor seat, the rotor body including a rotor flow channel defined by a rotor inlet, a rotor lumen and a rotor outlet;

wherein a fluid enters the inlet member and is discharged tangentially against the internal wall profile such that the fluid causes the rotor to spin with the contact portion and elastomeric sleeve providing frictional resistance to the rotor such that fluid discharged from the rotor outlet assumes a generally continuous stream defining a circular spray pattern.

2. The configurable rotary spray nozzle of claim 1, wherein the inlet member comprises a connecting end that extends through an inlet bore in the first outer shell member, the connecting end including a retention member for retaining the position of the inlet member with respect to the first outer shell member.

3. The configurable rotary spray nozzle of claim 1, wherein the first outer shell member and the second outer shell member are adapted for threadable engagement to define the outer shell.

4. The configurable rotary spray nozzle of claim 1, further comprising an internal shell face seal adapted to sealingly engage the first molded internal shell member and the second molded internal shell member as the first outer shell member and the second outer shell member are threadably engaged.

5. The configurable rotary spray nozzle of claim 1, further comprising a cover member adapted for detachable positioning over the second outer shell member.

* * * * *